US010575646B2

(12) United States Patent
Roizner

(10) Patent No.: US 10,575,646 B2
(45) Date of Patent: Mar. 3, 2020

(54) MEDITATION SEAT

(71) Applicant: Via Sur Investments LLC, Sunny Isles Beach, FL (US)

(72) Inventor: Osvaldo A. Roizner, North Miami Beach, FL (US)

(73) Assignee: Osvaldo A. Roizner-Frenkiel, North Miami Beach, FL (US)

( * ) Notice: Subject to any disclaimer, the term of this patent is extended or adjusted under 35 U.S.C. 154(b) by 459 days.

(21) Appl. No.: 15/177,422

(22) Filed: Jun. 9, 2016

(65) Prior Publication Data

US 2017/0318970 A1 Nov. 9, 2017

Related U.S. Application Data

(60) Provisional application No. 62/333,545, filed on May 9, 2016.

(51) Int. Cl.
*A47C 3/16* (2006.01)
*A47C 15/00* (2006.01)

(52) U.S. Cl.
CPC ..... *A47C 3/16* (2013.01); *A47C 15/004* (2013.01)

(58) Field of Classification Search
CPC .. A47C 3/16; A47C 15/00; A47C 7/00; A47C 7/004
USPC ..... 297/452.21
See application file for complete search history.

(56) References Cited

U.S. PATENT DOCUMENTS

D216,448 S 1/1970 Vasilatos
3,890,004 A * 6/1975 Rail ..... A47C 3/16 297/423.1
5,134,740 A 8/1992 Summer
D355,999 S 3/1995 Townsend
5,876,098 A 3/1999 Conaway et al.
D435,974 S 1/2001 Hsu et al.
6,328,385 B1 12/2001 Lau
D591,064 S 4/2009 Lee et al.
D596,414 S 7/2009 Natuzzi
D596,862 S 7/2009 Paulin
(Continued)

OTHER PUBLICATIONS

U.S. Appl. No. 29/560,052, Search Notes.
(Continued)

*Primary Examiner* — Milton Nelson, Jr.
(74) *Attorney, Agent, or Firm* — Pearson IP; Loren Donald Pearson

(57) ABSTRACT

A specially designed seat assembly allows a user to sit in lotus style meditation position while meditating. The seat assembly positions and elevates the user in order to provide comfort while holding the user in the correct position. The seat assembly can provide dual level support through an upper platform and lower platform. The seat assembly is specially shaped in order to conform to the contours of the user. The knees are elevated by the upper platform, and the feet and ankles are drawn inward and supported from the ground by the lower platform. The user is held in a traditional lotus style seating position. The seat assembly allows for the user to remain in a relaxed state, free from discomfort. The seat assembly is supported by a metal skeleton, which prevents the seat assembly from becoming deformed upon repeated use. The seat assembly has a cushion formed around the metal skeleton, which is stable, yet comfortable for the user.

19 Claims, 5 Drawing Sheets

(56) References Cited

U.S. PATENT DOCUMENTS

| | | | |
|---|---|---|---|
| 7,628,455 | B2 | 8/2009 | Brodeur |
| D594,244 | S | 10/2009 | Williams |
| D673,410 | S | 1/2013 | O'Connell |
| D686,684 | S | 7/2013 | Wolfinbarger |
| D723,812 | S | 3/2015 | Weyts |
| D782,593 | S | 3/2017 | Osimo |
| D787,232 | S | 3/2017 | Kassab Arabo |
| D785,960 | S | 5/2017 | Davis et al. |
| 2012/0124749 | A1 | 5/2012 | Lewman |

OTHER PUBLICATIONS

"Alexia Meditation Seat English" (Alexia Meditation Seat), Jan. 18, 2016, retrieved from the Internet Aug. 3, 2017 <url=https://www.youtube.com/watch?v=TBd3WIy3aAM>; entire document, especially Video 0:22, );35, 0:55, 0:58, and caption.

PCT/US2017/036907, PCT International Search Report, dated Sep. 1, 2017.

* cited by examiner

MEDITATION SEAT

CROSS-REFERENCE TO RELATED APPLICATIONS

This application claims the benefit of the U.S. Provisional Application No. 62/333,545, filed May 9, 2016, which is hereby incorporated by reference. The content of U.S. Design patent application No. 29/560,052 is hereby incorporated by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to chairs and seating, and in particular to seats to be used when meditating.

Description of the Related Art

Meditation is a practice where an individual trains the mind or induces a mode of consciousness, either to realize some benefit or for the mind to simply acknowledge its content without becoming identified with that content, or as an end in itself.

People who meditate often prefer to sit in a lotus style position. A lotus style position is a cross-legged sitting asana originating in meditative practices of ancient India, in which the feet are placed on opposing thighs. The asana is said to resemble a lotus, to encourage breathing proper to associated meditative practices, and to foster physical stability.

Positioning oneself in the lotus position can be difficult and uncomfortable. Ordinarily, a person sits on a pillow or flat cushion in order to meditate more comfortably. The pillow or cushion is used to elevate a person's buttocks relative to his or her feet. The pillow cushions one's buttocks when meditating on a hard surface. When using a pillow, the person's feet remain on the hard floor. In addition, a pillow does not provide lateral support to the person's feet. Ordinary pillows and cushions fail to provide the optimal position and support.

Meditation sessions can be greatly enhanced if the person is more comfortable while meditating. Often it is hard for people to find a comfortable position while meditating. When sitting in a traditional crossed leg position the meditating person's knees may feel tight and circulation may even be cut off, causing their legs to fall asleep. When discomfort arises, the posture will often suffer as well. The person may begin to slouch, which over time may cause soreness in the lower back.

Often the pain and soreness increases to the point that the person can no longer meditate in the lotus style position. When this happens people then resort to meditating in a traditional four legged chair. This places the person's legs and back at a ninety degree (90°) angle, which brings them out of the lotus style position.

Accordingly, a need exists for a seat to improve the support that the users experience during meditation sessions.

BRIEF SUMMARY OF THE INVENTION

The invention encompasses a meditation seat, which is also referred to as a seat assembly for positioning a person in lotus style meditation.

An object of the invention is to support and situate the body in an optimal position to relieve discomfort.

An object is to provide cushioned support for a person's feet, knees, and buttocks.

An object is to provide a person with lateral stabilization while meditating in the lotus position.

The seat assembly provides a seat for the person to place their buttocks. The present invention also provides foot stops for both the left and the right feet. The foot stops are located below the seat. The person using the seat assembly sits in a crossed manner in which their right foot is positioned toward the left side of the person and the left foot is positioned toward the right side of the person. Both feet, left and right, are forward of the person while the person is seated in the seat assembly.

Each foot stop includes a lateral brace, which supports the bottom of the foot, and a medial support, which supports the side of the foot.

The seat assembly includes support for the person's knees while seated in the seat assembly. When the person bends their legs and crosses their ankles, at least one of the person's knees are supported above their feet and forward relative to the seat on which the person is sitting. The interior portion of the knee support holds the feet of the person in an inward (i.e. bottom of the foot facing medially) and forward (relative to the seat for the buttocks) manner, placing the person in the lotus style meditation position.

The knee support on the seat assembly is used to elevate the knee of the person above at least one of the right foot stop or the left foot stop. It is an object of the invention to support the knees above the feet to relieve pressure commonly caused when the knees rest on the feet in a traditional crossed leg seating style.

The knee support portion of the seat assembly is positioned to place the legs of the person above the waistline of the person. The elevation of the leg will vary depending on the height of the person. The taller the person using the seat assembly, the higher their leg will be relative to their waistline.

It is an object of the invention to provide support to the person using the seat assembly. The area between the left foot stop and the right foot stop can form a bed. The bed is used to elevate the person's feet off the floor during use. By elevating and supporting the feet of the person, the person's comfort level will be optimized.

The bed that is formed between the left foot stop and the right foot stop may be convex in shape in one embodiment. By being convex in shape, the bed will receive and hold the feet of the person over a longer surface area of the person's feet. The convex shape contours to the person's ankles. In other embodiments, of the present invention, the bed may be flat or be concave in shape.

The medial foot support is the area of the bed that can hold the side of the person's feet and their ankles. Note: the medial foot support may be completely absent from the seat assembly. In an embodiment without the medial foot support, the person using the seat assembly can press their feet against the lateral foot stop.

It is an object of the present invention to contour to the shape of the person using the seat assembly. The left lateral brace and the left medial foot support meet and form an angle. The angle formed can be acute, which places the person's foot in a preferred position. In other embodiments, this angle may vary, be at ninety degree (90°) or even be obtuse.

The right lateral brace and the right medial foot support meet and form a similar angle to the angle formed on the left side. In the preferred embodiment, the angles formed on both the left and right side match, but in other embodiments the angles formed may differ from the right to the left.

It is an object of the invention to provide for repeated use. To allow for repeated use the seat assembly must be structurally sound and the contouring of the seat assembly must remain viable. In one embodiment, the structural rigidity is provided with the use of an interior skeleton. The skeleton provides for the framing of the seat assembly to allow a person to use the seat assembly over and over without deformation. In other embodiments, the structural rigidity of the seat assembly may be provided in other ways, including but not limited to being formed from a more rigid material that does not need an interior skeleton to maintain shape.

It is an object of the present invention to provide both optimal comfort and stability. In embodiments with a structural skeleton incorporated, the skeleton is surrounded by a cushion. This cushion provides comfort by acting as a shock absorber for the various members of the person's body. The cushion mitigates the pain that may occur if the seat assembly were stiff.

In embodiments using the skeleton, the skeleton must retain its shape. In an effort to retain the shape, the skeleton may be composed of metal. Metal may be used for structural strength. By using metal as the base material for the composition of the skeleton, the seat assembly will be useful for persons of varying weight and size. In other embodiments the skeleton may be made from less durable materials such as plastics.

It is an object of the invention to provide comfort during meditation sessions. The cushion is utilized to provide comfort. This cushion may be composed of neoprene foam. Neoprene is a flexible and durable material. Neoprene foam can resist breakdown by water, which allows for repeated use without degradation of the seat assembly.

It is an object of the invention to provide comfort for the person during use. In embodiments incorporating a cushion, the cushion forms the seat, knee support, and the lateral braces. It is vital to provide comfort in all areas in which the person is contacting the seat assembly.

In embodiments incorporating a bed between the left foot stop and the right foot stop, the bed may be composed of a cushion. The bed includes the left medial foot support and the right medial foot support. By being composed of a cushion material, the left medial foot support and the right medial foot support will maintain the feet and ankles of the person in a soft but supportive manner. The cushion may relieve the pain that would be associated with an overly stiff material.

It is an object of the present invention to place the person in a lotus style position for meditation. The left lateral brace and the left medial brace of the seat assembly are designed to receive the right foot of the person. The left lateral brace and the left medial brace are stationed forward of the seat. By placing the left lateral brace and the left medial brace forward of the seat, the person is able to place their weight upon the seat which relieves the pressure that would occur if the feet were positioned below the seat. By relieving pressure from the feet, the person will achieve a more sustained relaxed state, which is optimal for meditation.

It is an object of the invention to create comfort for both body and mind. One aspect of this comfort is security from belief that the seat assembly will not tip over. To refrain from tipping over, the surface areas are strategically designed. In the preferred embodiment, the top surface area of the seat assembly to the bottom surface area of the seat assembly is a ratio of one and one tenth to one (1.1:1.0). By having a top surface area 10 percent larger than the bottom surface area, the seat assembly provides increased seating area while not being so large in scale as to allow the seat assembly to tip over during use. In other embodiments, the ratio may increase or decrease in size so long as the ratio remains useable without tipping over.

The seat assembly may be viewed as a dual platform design. The dual platform includes both an upper platform and a lower platform. The upper platform is designed to support the buttocks, the left knee, and the right knee of the person. The lower platform is designed to support the left and right feet of the person. The upper platform is placed at a higher elevation relative to the lower platform.

The lower platform of the seat assembly may be convex in shape. The lower platform is utilized for the feet of the person. When the person is sitting in the seat assembly, his or her feet are crossed. By being convex in shape, the lower platform will fill the gap that is formed when the feet are crossed. The convex shape will provide more support than if the lower platform were flat. In other embodiments, the lower platform may be flat or concave in shape without deviating from the primary objective of the seat assembly, which is to provide a seat for lotus style meditation.

One objective of the upper platform of the seat assembly is to position the person by raising the knees of the person. The upper platform elevates both the left and right knee of the person above the waistline of the person. The buttocks of the person are placed on the seat, located on the rear portion of the upper platform. The feet are placed on the lower platform in a crossed manner. The feet are drawn inward, which then causes the knees to be elevated above the waistline. This positioning relieves pressure associated with having body parts rest against one another.

An objective of the seat assembly is to provide support and position the user in the lotus style meditation position. This is achieved by placing the buttocks on a seat, placing a left foot against a brace below the seat, placing a right foot against a brace below the seat, and supporting the left and right knees above the brace for the feet. By supporting the separate body parts of the person using the seat assembly in their individual capacity, optimal comfort is provided. The different body parts are allowed to rest on the seat assembly instead of resting on one another. This alleviates the pressure that occurs when the body parts do rest on one another.

One embodiment of the present invention is a seat assembly composed of two separate members, one upper platform and one lower platform. The upper and lower platform of the invention may be joined together as one uniform member, or may be two separate members. The embodiment with one uniform member is configured to have the left foot stop and the right foot stop connected to the upper platform, which includes seat for the person.

The seating assembly is formed to create a place of comfort and tranquility for the person using the seat assembly. An important aspect of tranquility is the knowledge that when using the seat assembly that the seat assembly will not tip over. In order to provide this assurance, the design is adequately balanced to create a center of gravity that is forward of the rear fulcrum pivot point of the seat assembly. The combination of the person and the seat creates this center of gravity. So long as this center of gravity is forward of the rear fulcrum pivot point of the seat assembly the user will not feel the sensation that they are going to tip over. When meditating, maintaining a relaxed state is important. By designing the seat assembly in a balanced manner, and considering all parameters, the seat assembly will provide the user with this relaxed state.

Other features of the invention are set forth in the appended claims.

Although the invention is illustrated and described herein as embodied, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

DETAILED DESCRIPTION OF THE INVENTION

Figure 1:
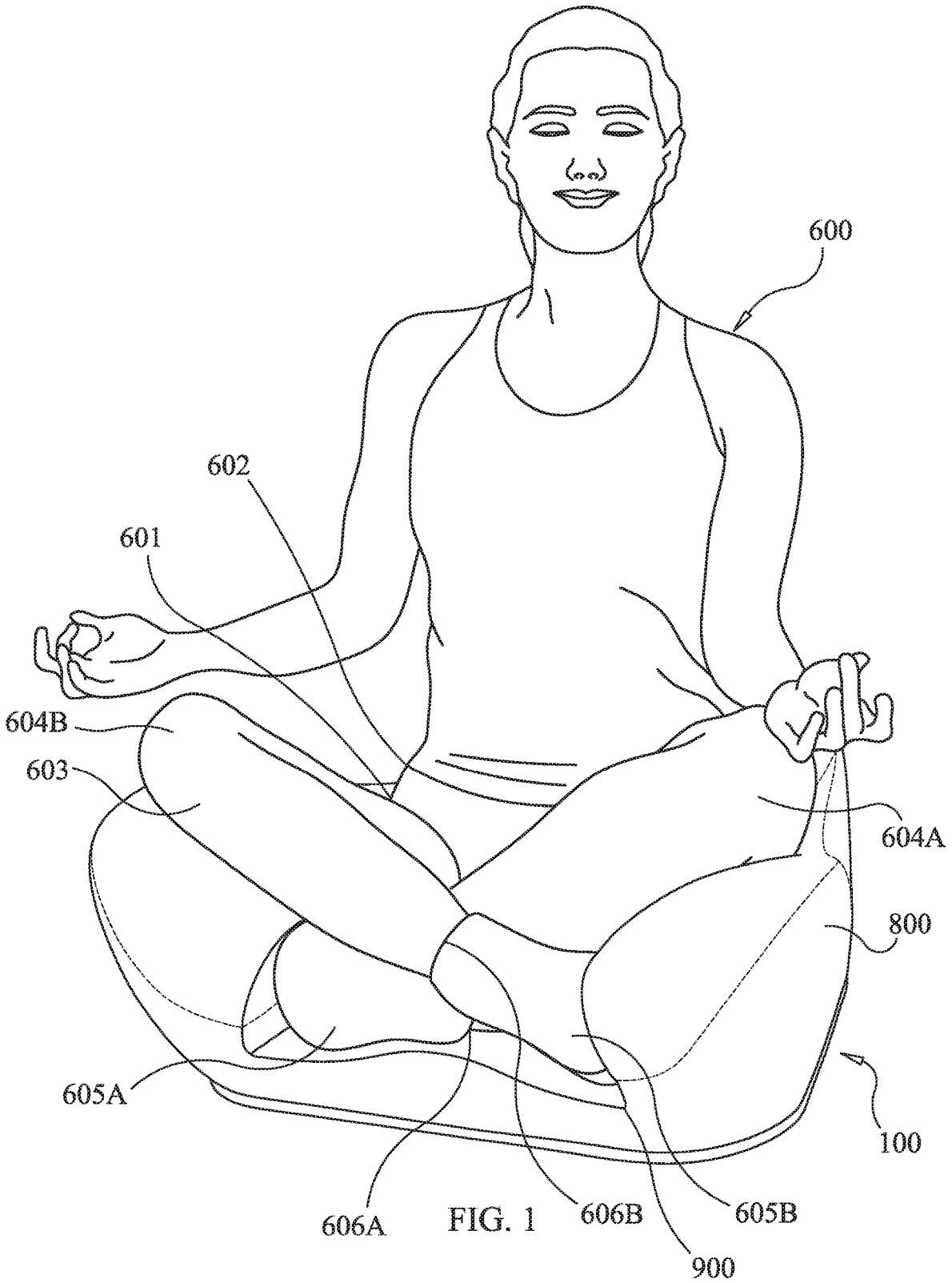
FIG. 1 is a perspective front side view of a seat assembly according to the invention with a person sitting in the lotus position.

Embodiments of the invention are described below and are shown in the figures of the drawing.

FIG. 1-5 show a preferred embodiment of a seat assembly 100.

FIG. 1 shows a person 600 sitting in the seat assembly 100 according to the present invention. The person 600 is seated in the seat assembly 100 in a lotus style meditation position. The lotus style position is one in which the person 600 has their left ankle 606A crossed over their right ankle 606B. The person 600 may also sit with their right ankle 606B crossed over their left ankle 606A; this alternate position is not shown in the figures. The person 600 is in an upright position with their buttocks 601 at the rear 101 of the seat assembly 100. The left knee 604A and the right knee 604B are raised above the waistline 602 by the seat assembly 100. The leg 603 of the person 600 is in a bent but relaxed state. The left foot 605A and the right foot 605B of the person 600 are below and forward of the buttocks 601. The left foot 605A and the right foot 605B are comfortably supported by an angle 900 formed by the seat assembly 100. The seat assembly 100 is composed of a cushion 800 to provide comfort for the person 600 while in use.

The seat assembly 100 is used for meditation in a lotus style seating position. The person 600 is comfortably supported by the seat assembly 100. The left foot 605A and the right foot 605B are pulled inward, relative to the buttocks 601, in front of the person 600 and supported by the seat assembly 100. The buttocks 601 are placed in an elevated position on the rear section 101 of the seat assembly 100. The left knee 604A and the right knee 604B are elevated to a position higher than the left foot 605A and the right foot 605B. The left ankle 606A and the right ankle 606B are also supported by the seat assembly 100. The person 600 is removed from the floor and placed in order to provide optimal comfort and relation. By supporting the various body parts, the seat assembly 100 supports the person 600 in a comfortable upright posture optimal for meditation.

The cushion 800 is composed of neoprene foam in the preferred embodiment, but may be formed by other sponge-like material in other embodiments. The actual composition is not pertinent so long as the person 600 is accommodated comfortably in the seat assembly 100. The seat assembly 100 is composed of the cushion 800 in order to support the person 600 optimally. The cushion 800 compresses slightly, which alleviates the pressure on the various body parts on the person 600. By alleviating pressure on the person 600, the seat assembly 100 removes stress and allows for peaceful meditation.

Figure 2:
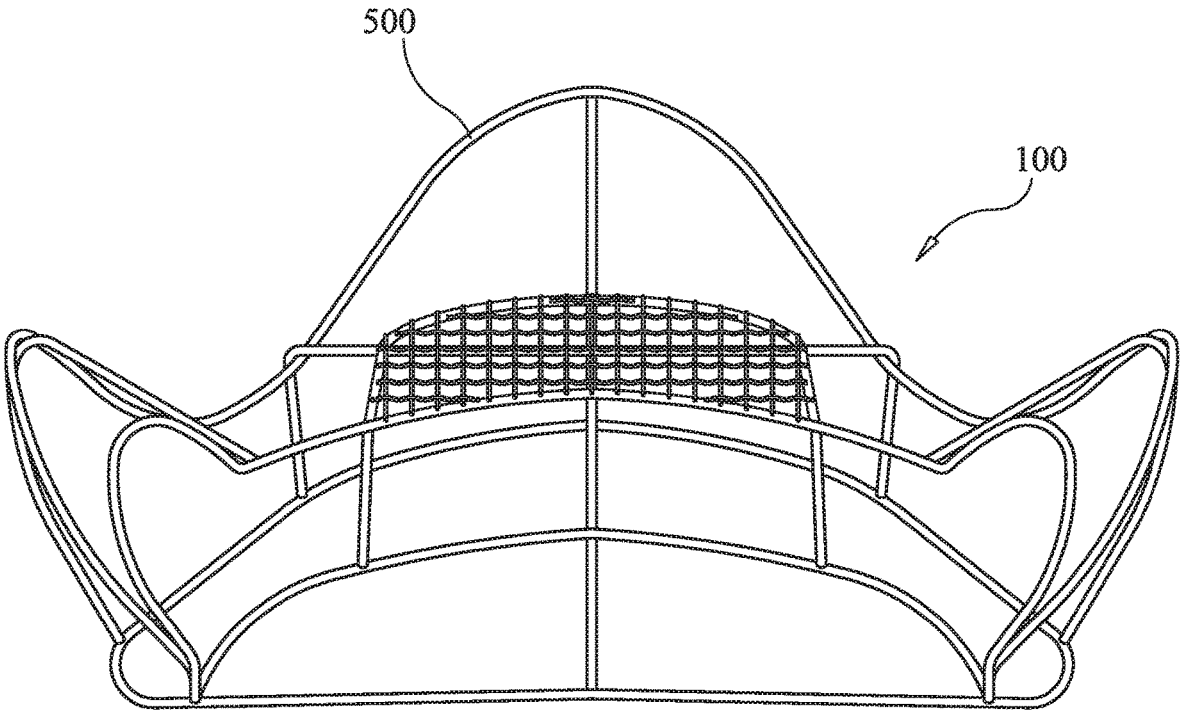
FIG. 2 is an isometric front view of a skeleton, which is within the seat assembly shown in FIG. 1.

FIG. 2 shows a skeleton 500 located within the seat assembly 100. The skeleton 500 is surrounded by a cushion 800 (as shown in FIG. 1).

The skeleton 500 supports the person 600 seated on the seat assembly 100. The skeleton 500 provides the seat assembly 100 with the structural rigidity necessary to maintain the person 600 in the correct position. The seat assembly 100 is designed for repeated use. With the use of the skeleton 500 inside the seat assembly 100, the seat assembly 100 will retain the shape in each use. The skeleton 500 provides both support and shape of the seat assembly 100. The skeleton 500 may be composed of one continuous piece of metal in one embodiment. The skeleton 500 may be composed of separate pieces of metal, preferably steel tubing, in separate embodiments. The skeleton 500 may also be composed of any other structurally rigid material capable of supporting the seat assembly 100 in the desired shape. In other embodiments, which are not shown, the seat assembly 100 may be formed without the use of the skeleton 500, and may stand on its own by way of the cushion 800 (as shown in FIG. 1) being rigid to retain shape.

Figure 3:
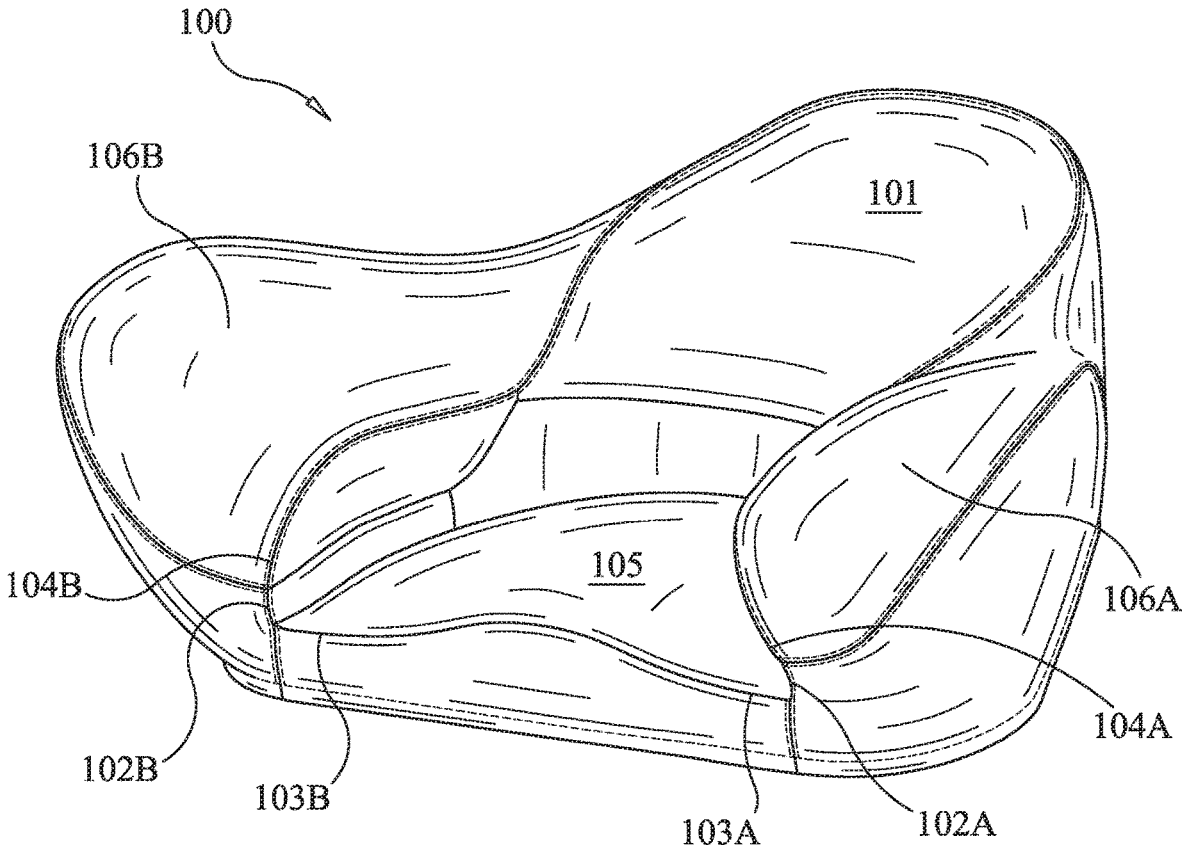
FIG. 3 is a front perspective view of the seat assembly shown in FIG. 1.

FIG. 3 shows a preferred seat assembly 100 according to the present invention. The seat assembly 100 provides support for the person 600 (as shown in FIG. 1), while positioning the person 600 in the lotus style meditation position. The buttocks 601 (as shown in FIG. 1) of the person 600 are placed on the seat 101 during use. The left knee 604A (as shown in FIG. 1) of the person 600 rests on the left knee support 106A. The right knee 604B (as shown in FIG. 1) of the person 600 rests on the right knee support 106B. The left medial foot support 103A and the right medial foot support 103B extend toward one another to form a bed 105. The bed 105 supports the left foot 605A, the right foot 605B, the left ankle 606A, and the right ankle 606B of the person 600 (as shown in FIG. 1). In the shown embodiment, the bed 105 has a convex shape; however, in alternative embodiments, the bed 105 may be flat or be concave in shape. The left foot 605A of the person 600 is crossed over to the right foot stop 102B and the right foot 605B of the person 600 is crossed over to the left foot stop 102A. The left ankle 606A is supported by the right medial foot support

103B and the right ankle 606B is supported by the right medial foot support 103A. The left lateral brace 104A, left foot stop 102A, and the left medial foot support 103A join together to form an angle 900 (shown in FIG. 1). In the embodiment shown, the angle 900 is acute. Although in other embodiments the angle 900 may vary in degree. The right lateral brace 104B, right foot stop 102B, and the right medial foot support 103B form a similar angle 900 on the right side of the seat assembly 100.

The seat assembly 100 is optimal for meditation in the lotus style meditation position. The person 600 is placed in an upright position with buttocks 601 placed on the seat 101. The left knee 604A and the right knee 604B are raised above the ground and off of the left foot 605A or the right foot 605B. By raising the knees off of the ground and feet the person 600 is able to remain comfortable during the meditation session. Optimal comfort during meditation is critical in order to obtain a fulfilling meditation experience. In the shown embodiment the left foot 605A and the right foot 605B remain off of the ground. In alternative embodiment the knees of person 600 may remain off of the ground while the feet remain rested on the ground. It is the objective of the seat assembly 100 to provide the best comfort possible for the person 600 to utilize the seat assembly 100 during meditation.

Figure 4:
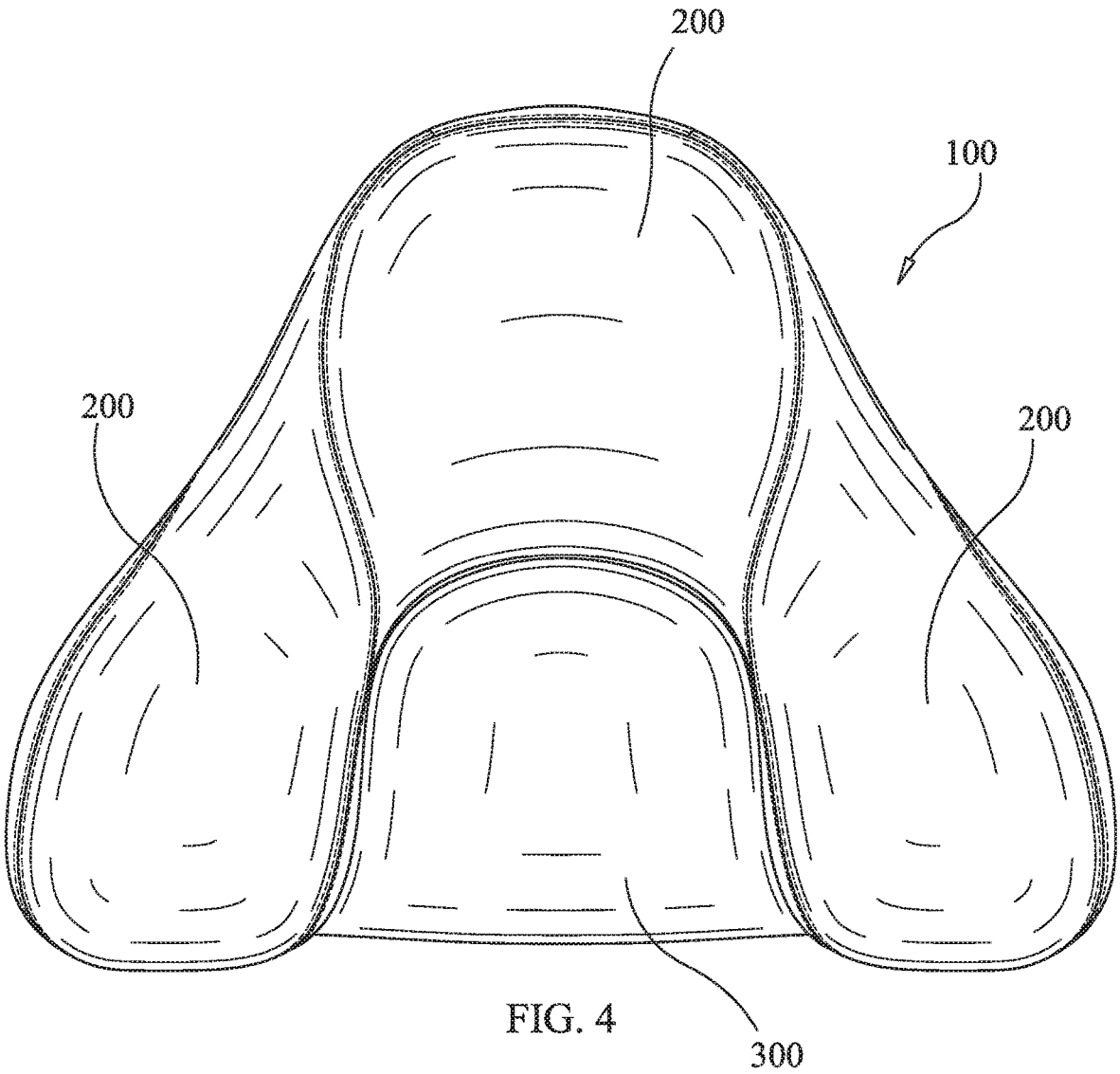
FIG. 4 is a top side view of the seat assembly shown in FIG. 1.

FIG. 4 shows a preferred embodiment of a seat assembly 100 according to the present invention. The seat assembly 100 positions the person 600 (as shown in FIG. 1) on an upper platform 200 and a lower platform 300. The upper platform 200 is located above and around the exterior of the lower platform 300. The person 600 places their buttocks 601 on the upper platform 200 with the left foot 605A and the right foot 605B being placed on the lower platform 300. In one embodiment, the upper platform 200 and the lower platform 300 are one continuous member. In another embodiment, which is not shown, the upper platform 200 and the lower platform 300 are separate members.

The seat assembly 100 includes an upper platform 200 and a lower platform 300 in one embodiment. In a separate embodiment, the upper platform 200 stands alone as the sole platform for supporting the person 600. The embodiment shown includes both the upper platform 200 and the lower platform 300. The upper platform 200 supports the left knee 604A at the left knee support 106A (as shown in FIG. 3), right knee 604B at the right knee support 106B (as shown in FIG. 3), and the buttocks 601 at the seat 101 (as shown in FIG. 3). The lower platform 300 supports the left foot 605A at the right foot stop 102B (as shown in FIG. 3), right foot 605B at the left foot stop 102A (as shown in FIG. 3), left ankle 606A at the right medial foot support 103B (as shown in FIG. 3), and right ankle 606B at the left medial foot support 103A (as shown in FIG. 3). The leg 603 of the person 600 is bent while sitting in the seat assembly 100. The leg 603 is elevated above the waistline 602 of the person 600, placing them in the lotus position. The use of an upper platform 200 removes the buttocks 601 of the person 600 from the floor which allows sustained comfort for the duration of the use of the seat assembly 100.

Figure 5:
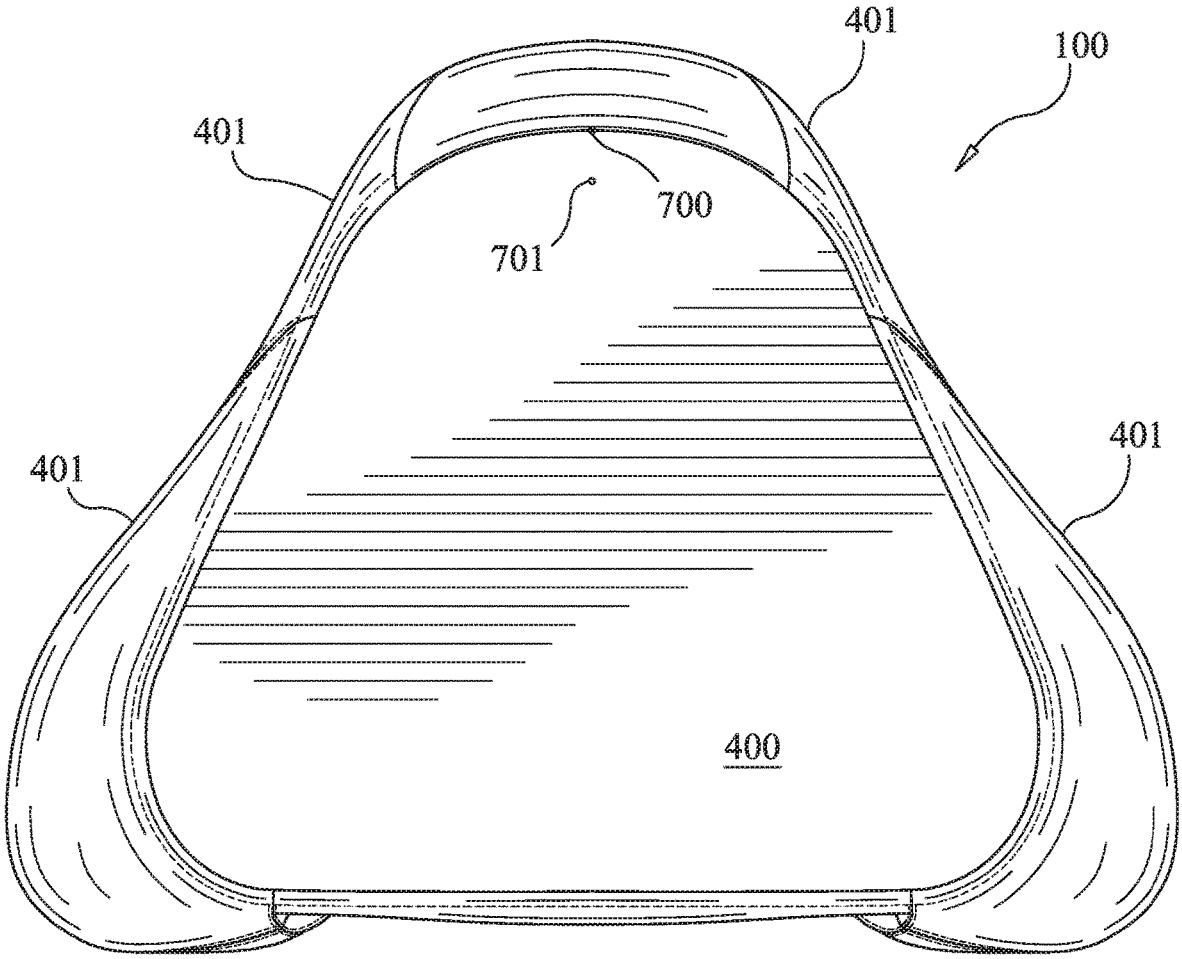
FIG. 5 is a bottom side view of the seat assembly shown in FIG. 1.

FIG. 5 shows a preferred seat assembly 100 according to the present invention. The invention as shown depicts a seat assembly 100 with both the upper platform 200 and the lower platform 300 joined together. The outer perimeter of the upper platform 200 forms a top surface area 401. The bottom surface area 400 is the area in which the seat assembly 100 rests on the ground. The seat assembly 100 has a rear fulcrum pivot point 700 located at the rear of the seat assembly 100. The seat assembly 100 has a center of gravity 701 which is located based on the combination of the seat assembly 100 and the person 600 (as shown in FIG. 1). The center of gravity 701 of the seat assembly 100 and the person 600 is forward of the rear fulcrum pivot point 700.

The seat assembly 100 is structured to provide balance for the person 600. The ratio of the top surface area 401 to the bottom surface area 400 is 1.1 to 1.0 in the embodiment shown, but is not limited to this ratio. The ratio of the top surface area 401 to the bottom surface area 400 is set to provide optimal area for the person 600, while preventing the seat assembly 100 from tipping while the person 600 is using the seat assembly 100. The center of gravity 701 of the seat assembly 100 should remain forward of the rear fulcrum pivot point 700 in order to prevent the seat assembly 100 from tipping over backwards. By creating a center of gravity 701 forward of the rear fulcrum pivot point 700 the person 600 will feel supported and unconcerned about tipping backward. It is an object of the present invention to provide comfort to the person 600 while using the seat assembly 100. One aspect of this comfort is the removal of the fear that is present in an unstable seat.

The seat assembly is made according to the following procedure. A skeleton, as shown in FIG. 2, is assembled from steel tubing. Next a block of foam corresponding to the shape of the chair is placed over the skeleton. Next upholstery is placed over the block; the upholstery is contoured to the shape of the block. Preferred types of upholstery include leather or fabric.

Unless otherwise mentioned the reference numbers are used consistently throughout the figures.

What is claimed is:

1. A seat assembly for supporting a person in a lotus position, comprising:

a seat for supporting a buttocks of the person, said seat declining anteriorly and continuously;

a left foot stop including a left medial foot support for supporting a side of a right foot of the person and a left lateral brace for supporting a bottom of the right foot of the person, said left lateral brace being connected to said left medial foot support, said left medial foot stop being located lower than said seat; and a right foot stop including a right medial foot support for supporting a side of a left foot of the person and a right lateral brace for supporting a bottom of the left foot of the person, said right lateral brace being connected to said right medial foot support, said right foot stop being located lower than said seat.

2. The seat assembly according to claim 1, further comprising:

a knee support for supporting a knee of the person when the buttocks of the person is on the seat, the foot of the person is supported by the right foot stop or the left foot stop, the knee is bent and the foot is supported by said knee support being located forward relative to said seat.

3. The seat assembly according to claim 2, wherein said knee support is a left knee support, said left knee support elevating the left knee of the person above at least one of said right foot stop and said left foot stop.

4. The seat assembly according to claim 3, wherein said left knee support props a leg with the knee above a waistline of the person.

5. The seat assembly according to claim 1, further comprising a bed, said bed spanning between said left foot stop and said right foot stop.

6. The seat assembly according to claim 5, wherein said bed being convex.

7. The seat assembly according to claim 5, wherein said left medial foot support and said right medial foot support form at least a part of said bed.

8. The seat assembly according to claim 1, wherein said left lateral brace and said left medial foot support are connected and form an angle therebetween, said angle being acute.

9. The seat assembly according to claim 8, wherein: said right lateral brace and right medial foot support connect and form an angle there between being acute.

10. The seat assembly according to claim 1, further comprising a skeleton for providing rigidity, said skeleton supporting said seat, said left foot stop, and said right foot stop.

11. The seat assembly according to claim 8, wherein said left lateral brace and said left medial brace extend forward from said seat to receive the right foot of the person.

12. The seat assembly according to claim 1, wherein a top surface area of said seat assembly to a bottom surface area of said seat assembly is a ratio of 1.1 to 1.0.

13. The seat assembly according to claim 1, wherein said seat is connected to said left foot stop and said seat is connected to said right foot stop.

14. The seat assembly according to claim 13, wherein:

said seat, said left foot stop, and said right foot stop form a bottom surface;

a rear fulcrum pivot point is located at a rearmost position on said bottom surface; and a center of gravity of said seat, said left foot stop and said right foot stop, and a person when seated on said seat is forward of said rear fulcrum.

15. A seat assembly for supporting a person in a lotus position, comprising:

a seat for supporting a buttocks of the person;

a left foot stop including a left medial foot support for supporting a side of a right foot of the person and a left lateral brace for supporting a bottom of the right foot of the person, said left lateral brace being connected to said left medial foot support, said left medial foot stop being located lower than said seat;

a right foot stop including a right medial foot support for supporting a side of a left foot of the person and a right lateral brace for supporting a bottom of the left foot of the person, said right lateral brace being connected to said right medial foot support, said right foot stop being located lower than said seat;

a skeleton for providing rigidity, said skeleton supporting said seat, said left foot stop, and said right foot stop; and a cushion surrounding said skeleton.

16. The seat assembly according to claim 15, wherein said cushion is neoprene foam.

17. The seat assembly according to claim 15, wherein said cushion forms said seat, said knee support, and at least one of said left lateral brace and said right lateral brace.

18. The seat assembly according to claim 15, wherein said cushion forms said left medial foot support, and said right medial foot support.

19. A seat assembly for supporting a person in a lotus position, comprising:

a seat for supporting a buttocks of the person;

a left foot stop including a left medial foot support for supporting a side of a right foot of the person and a left lateral brace for supporting a bottom of the right foot of the person, said left lateral brace being connected to said left medial foot support, said left medial foot stop being located lower than said seat;

a right foot stop including a right medial foot support for supporting a side of a left foot of the person and a right lateral brace for supporting a bottom of the left foot of the person, said right lateral brace being connected to said right medial foot support, said right foot stop being located lower than said seat, and a skeleton for providing rigidity, said skeleton supporting said seat, said left foot stop, and said right foot stop; and the skeleton being composed of metal.

* * * * *